US005269744A

United States Patent [19]

Moll

[11] Patent Number: 5,269,744

[45] Date of Patent: Dec. 14, 1993

[54] TWO PLATE BUCKLE FOLDER

[76] Inventor: Richard J. Moll, c/o Dick Moll & Sons, Warminster, Pa. 18974

[21] Appl. No.: 886,365

[22] Filed: May 21, 1992

[51] Int. Cl.[5] ..... B65H 45/14

[52] U.S. Cl. ..... 493/421; 493/420

[58] Field of Search ..... 493/416, 419, 420, 421

[56] References Cited

U.S. PATENT DOCUMENTS

| | | | |
|---|---|---|---|
| 1,848,448 | 3/1932 | Weidner | 493/421 |
| 2,000,636 | 5/1935 | Flynt | 493/421 |
| 2,706,115 | 4/1955 | Rouan et al. | 493/421 |
| 3,008,707 | 11/1961 | McGarvey | 493/23 |
| 3,178,171 | 4/1965 | Springer et al. | 493/421 |
| 3,211,448 | 10/1965 | Stoothoff | 493/421 |
| 3,510,122 | 5/1970 | Gavaghan | 493/421 |
| 3,975,009 | 8/1976 | Brown | 493/14 |
| 4,619,101 | 10/1986 | Havey et al. | 53/117 |
| 4,668,212 | 5/1987 | Kotani | 493/216 |

*Primary Examiner*—William E. Terrell

*Attorney, Agent, or Firm*—Z. T. Wobensmith, III

[57] ABSTRACT

A two plate buckle folding machine, which can apply single buckle fold to card stock, and the like, and by disengaging shafts, shifting a fold plate into position, shifting a roller into position, and rotating a chute, change from a single to a two buckle fold folder.

2 Claims, 7 Drawing Sheets

TWO PLATE BUCKLE FOLDER

BACKGROUND OF THE INVENTION

1. Field of the Invention

This invention relates to a folder of the buckle fold multi-plate type, which folds card stock, and selectively applies one or two pocket folds thereto in a single machine.

2. Description of the Prior Art

There are many folding machines available, which apply one or more folds to sheets of paper and the like. These machines use more than one fold plate to accomplish the multi folds.

Paper stock used to make products with multi folds is usually of no greater thickness than four points, which can be readily bent around rollers in a fairly tight radius to form folds, without damage to the paper itself, or to the finish on the paper.

Card stock, which is of ten to eighteen point thickness, is also used to make products, which have one or more folds.

Card stock, due to its thickness, does not bend about the tight radius found in machines that fold four point paper stock, and the use of such machines to fold sheets of card stock would result in damage to its finish or damage to the stock itself. While some of the available machines might be able to apply a single buckle fold to card stock, the addition of a second fold in these machines is not practical due to space, and other considerations.

The use of a second machine to form a second fold is prohibitive due to the inconvenience, and costs involved. There has, therefore, been considerable interest in developing a machine that will perform one or more buckle folds on sheets of card stock.

The folder of the invention selectively applies one or two buckle folds to sheets of card stock, without the necessity of added equipment, and can be easily changed from a single fold to a two fold folder, and back again without disassembly of the folder.

SUMMARY OF THE INVENTION

A two plate buckle folding machine, which can apply one or two buckle folds to sheets -of card stock, by engagement of the stock with one or two fold plates, with the second fold plate, a guide, and selected rollers being shifted to convert the folder from a one to two fold folder.

The principal object of the invention is to provide a two plate buckle folder, which can selectively form one or two folds on a sheet of card stock.

A further object of the invention is to provide a folder of the character aforesaid, which can be easily converted from a one to a two fold folder and vice versa.

A further object of the invention is to provide a folder of the character aforesaid, which is fast and positive in its operation, and does not damage the card stock being folded.

A further object of the invention is to provide a folder of the character aforesaid, which is simple and inexpensive to construct, but which is durable, and requires minimum maintenance in operation.

A further object of the invention is to provide a folder of the character aforesaid, which can be changed from a one to a two fold folder by one operator.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENT

Figure 1:
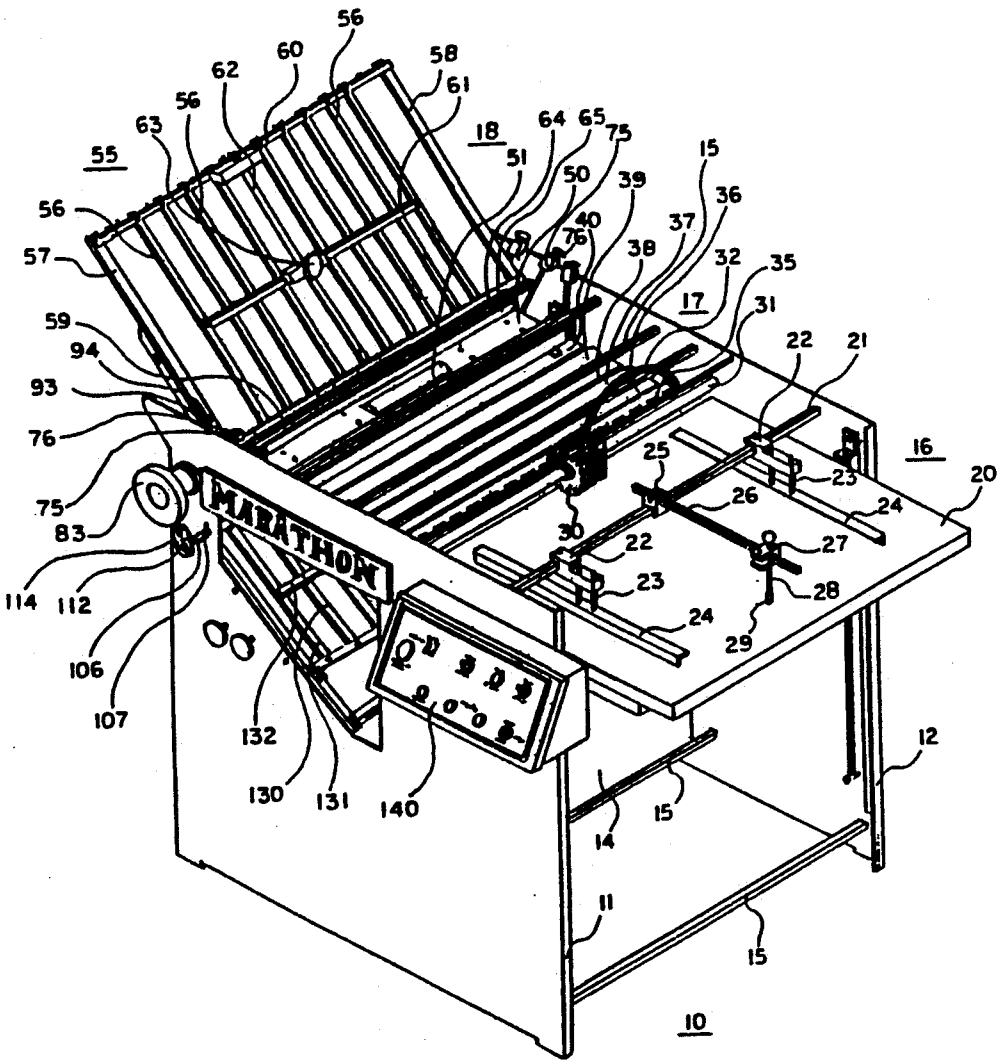
FIG. 1 is a view in perspective of the two plate buckle folder of the invention.
Figure 2:
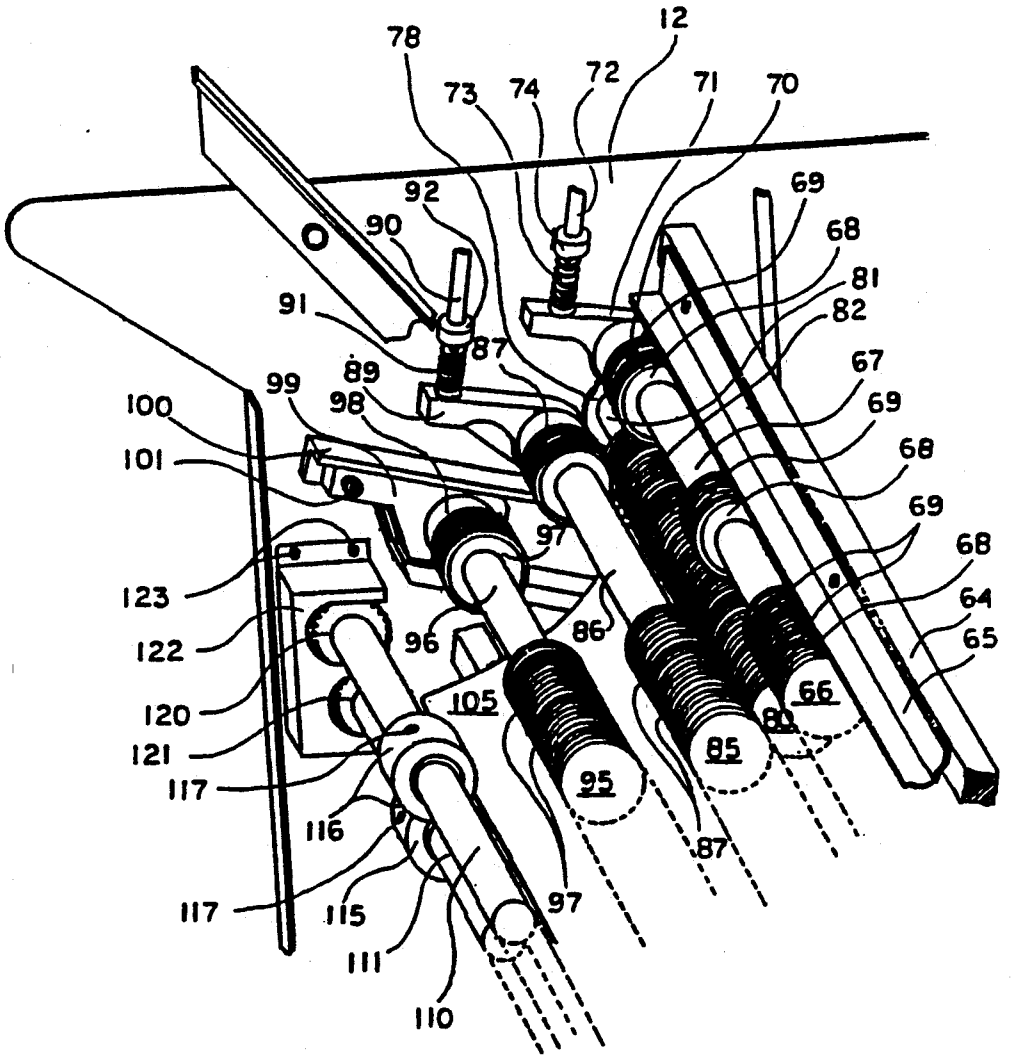
FIG. 2 is a fragmentary view, enlarged of a portion of the folder of FIG. 1, showing its mechanism in position for a single fold buckle fold.
Figure 3:
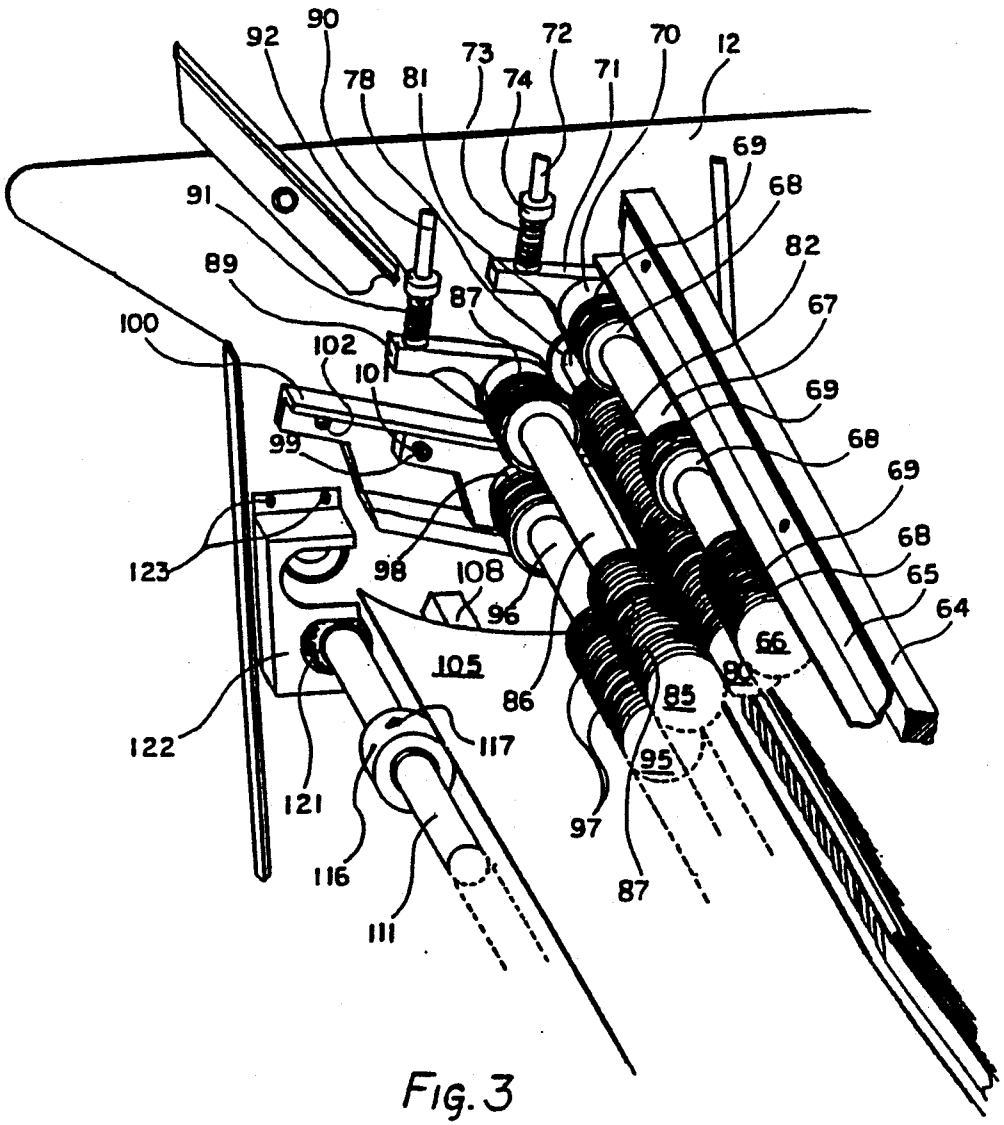
FIG. 3 is a view similar to FIG. 2, showing the mechanism in position for a two fold buckle fold.
Figure 4:
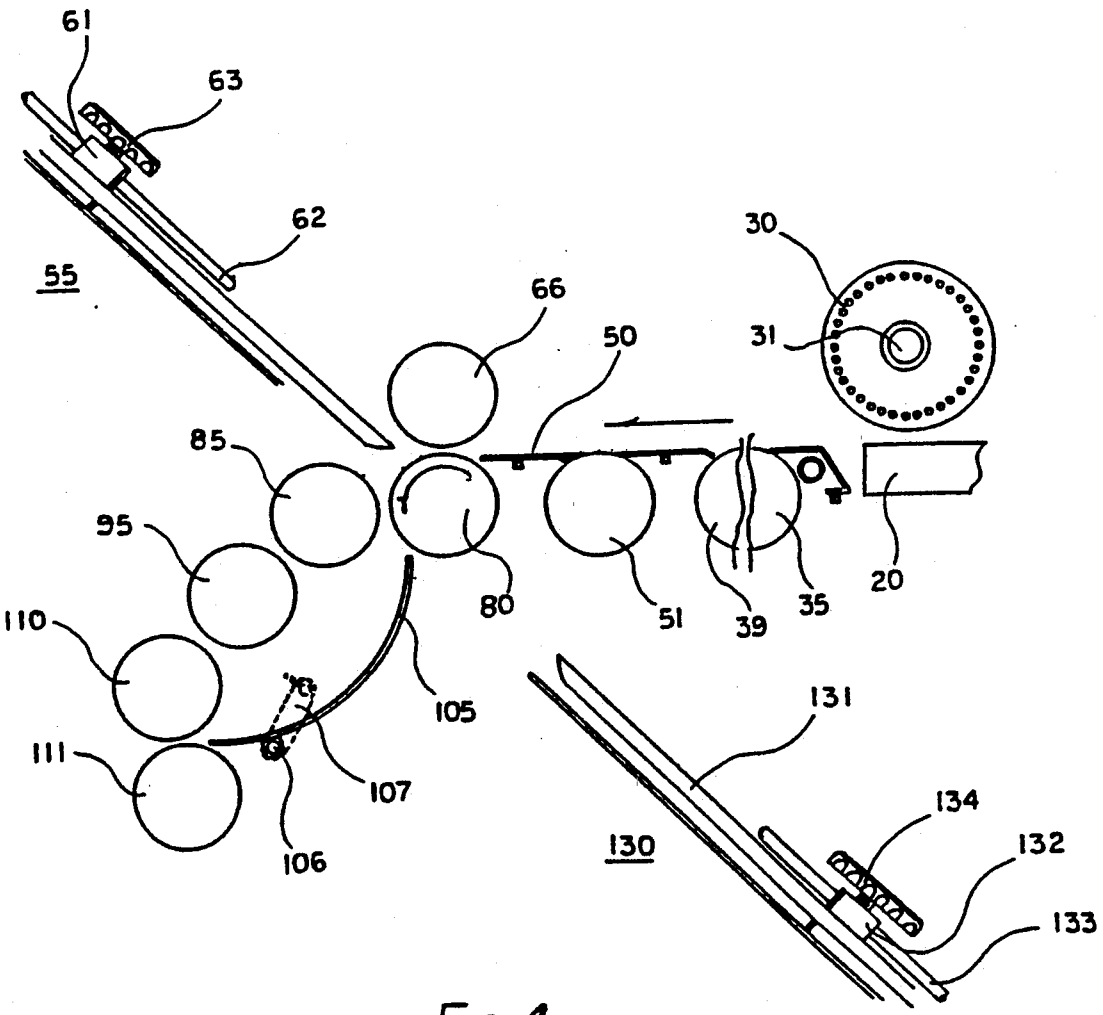
FIG. 4 is a diagrammatic view of a portion of the folder of the invention, illustrating the position of its mechanism for a single fold buckle fold.
Figure 5:
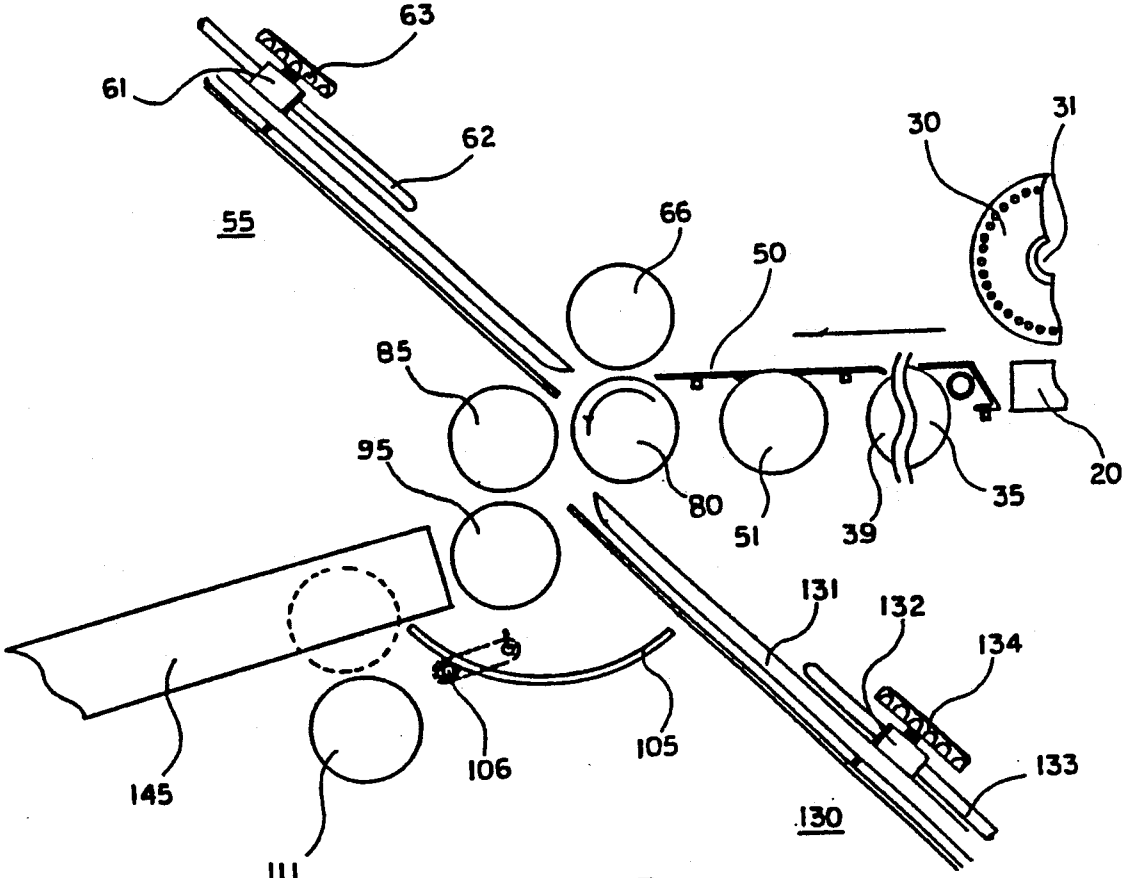
FIG. 5 is a view similar to FIG. 4, illustrating the folder mechanism in position for a two fold buckle fold.
Figure 6:
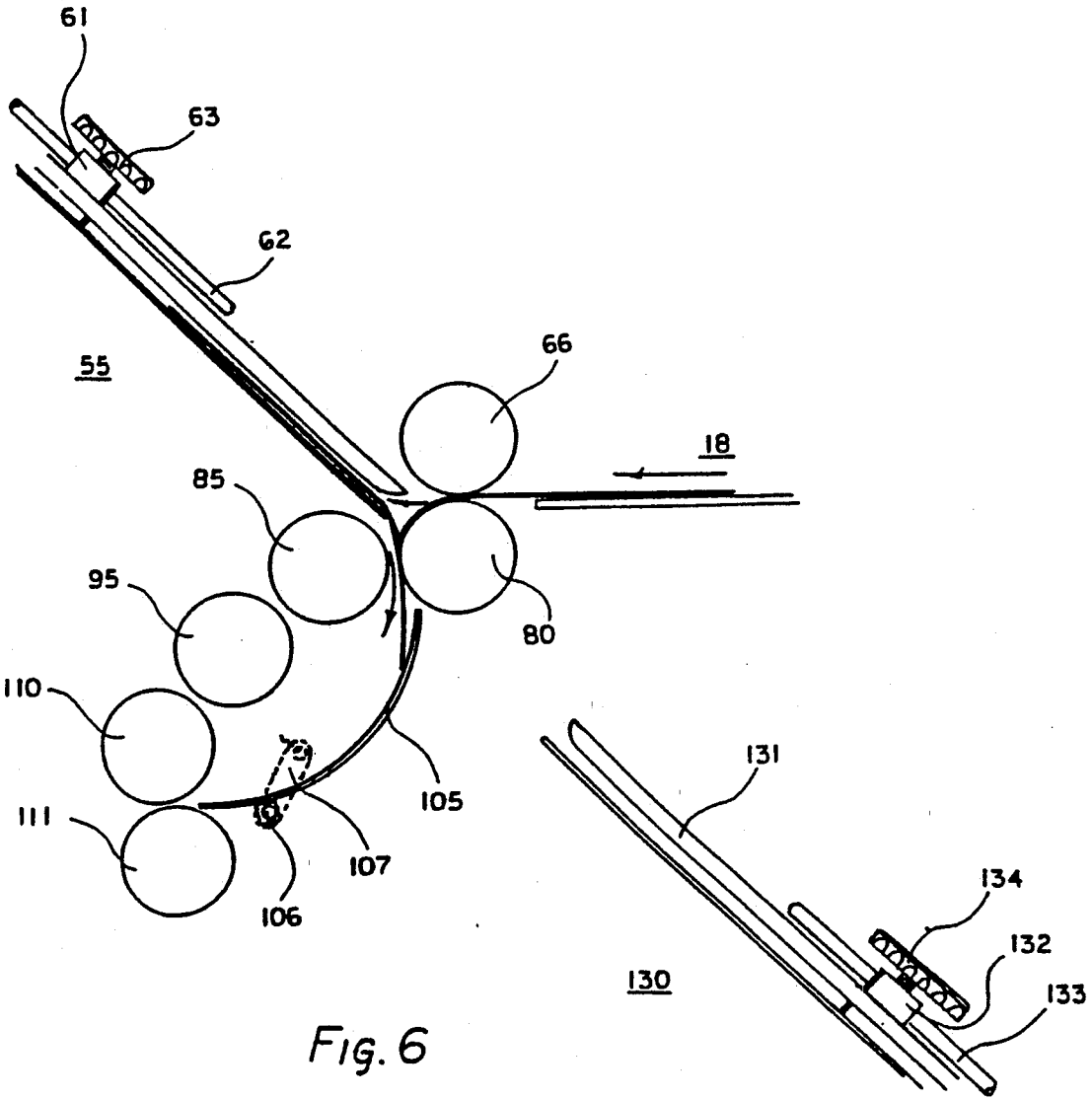
FIG. 6 is a diagrammatic view, similar to FIG. 4, illustrating the direction of travel of a sheet of card stock in the folder for a single fold buckle fold.
Figure 7:
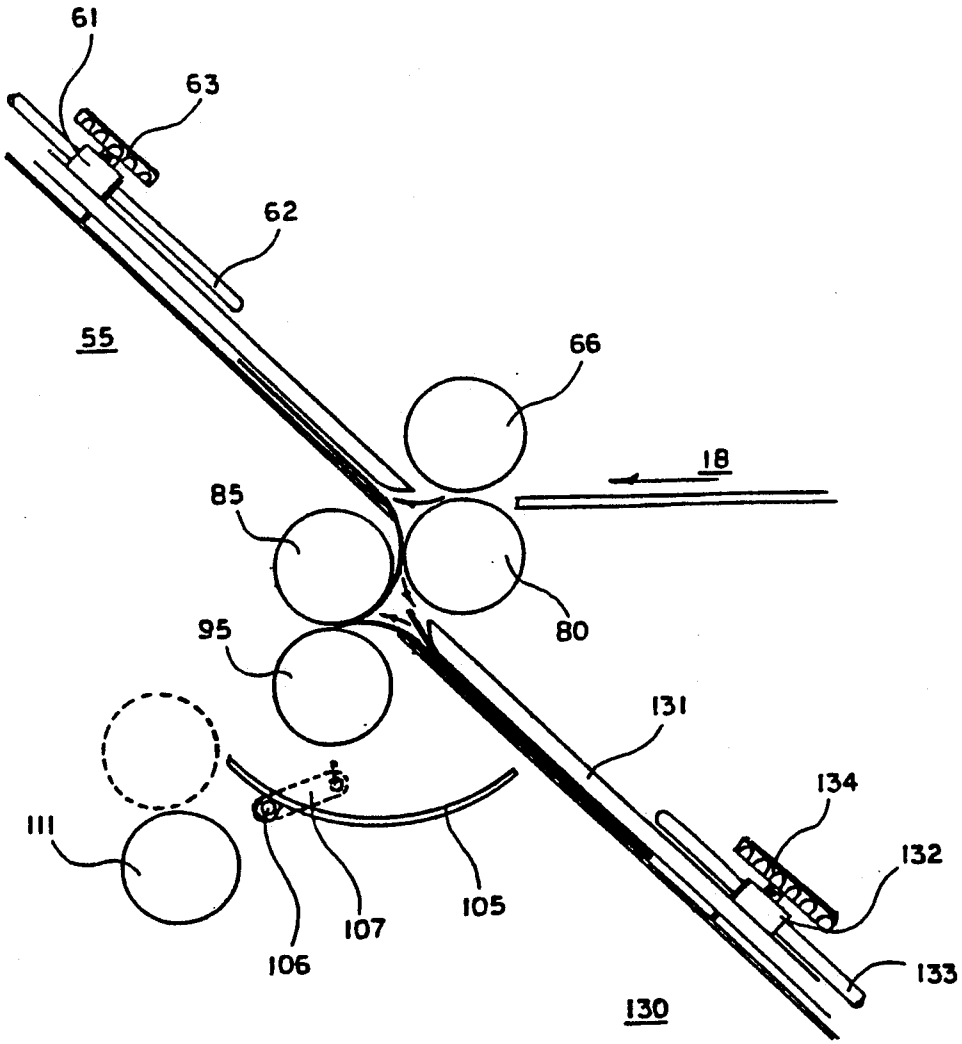
FIG. 7 is a diagrammatic view, similar to FIG. 5, illustrating the direction of travel of a sheet of card stock in the folder for a two fold buckle fold.
Figure 1:
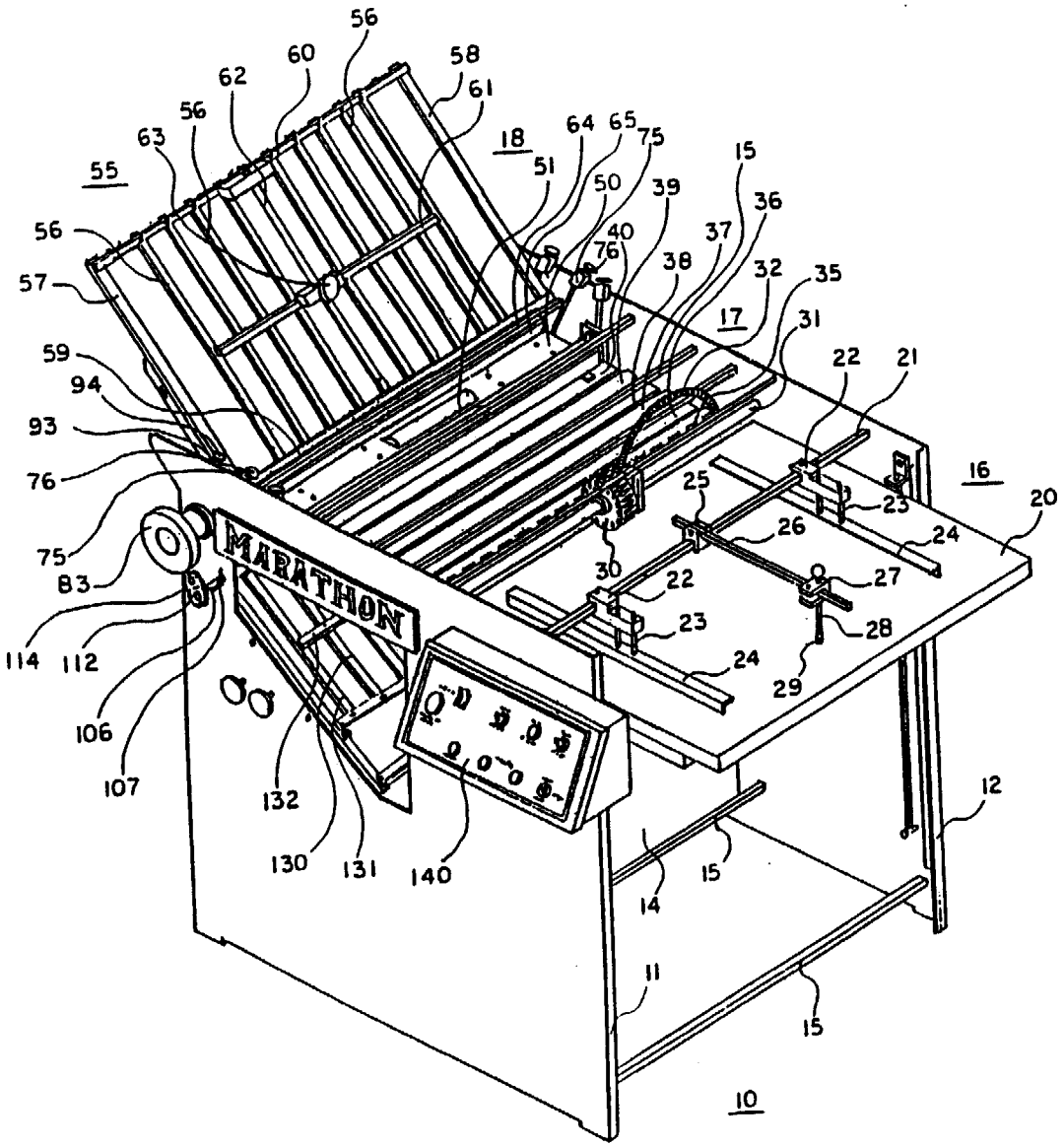
Figure 2:
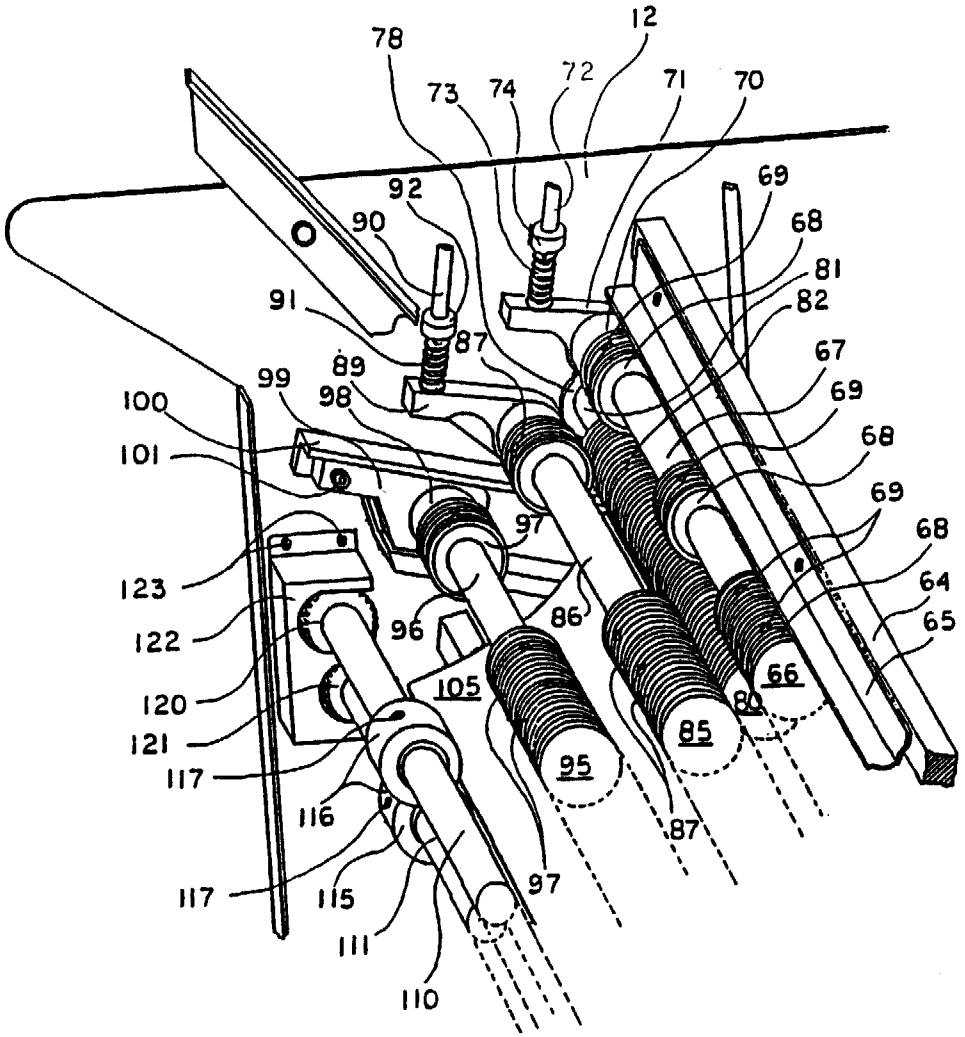
Figure 3:
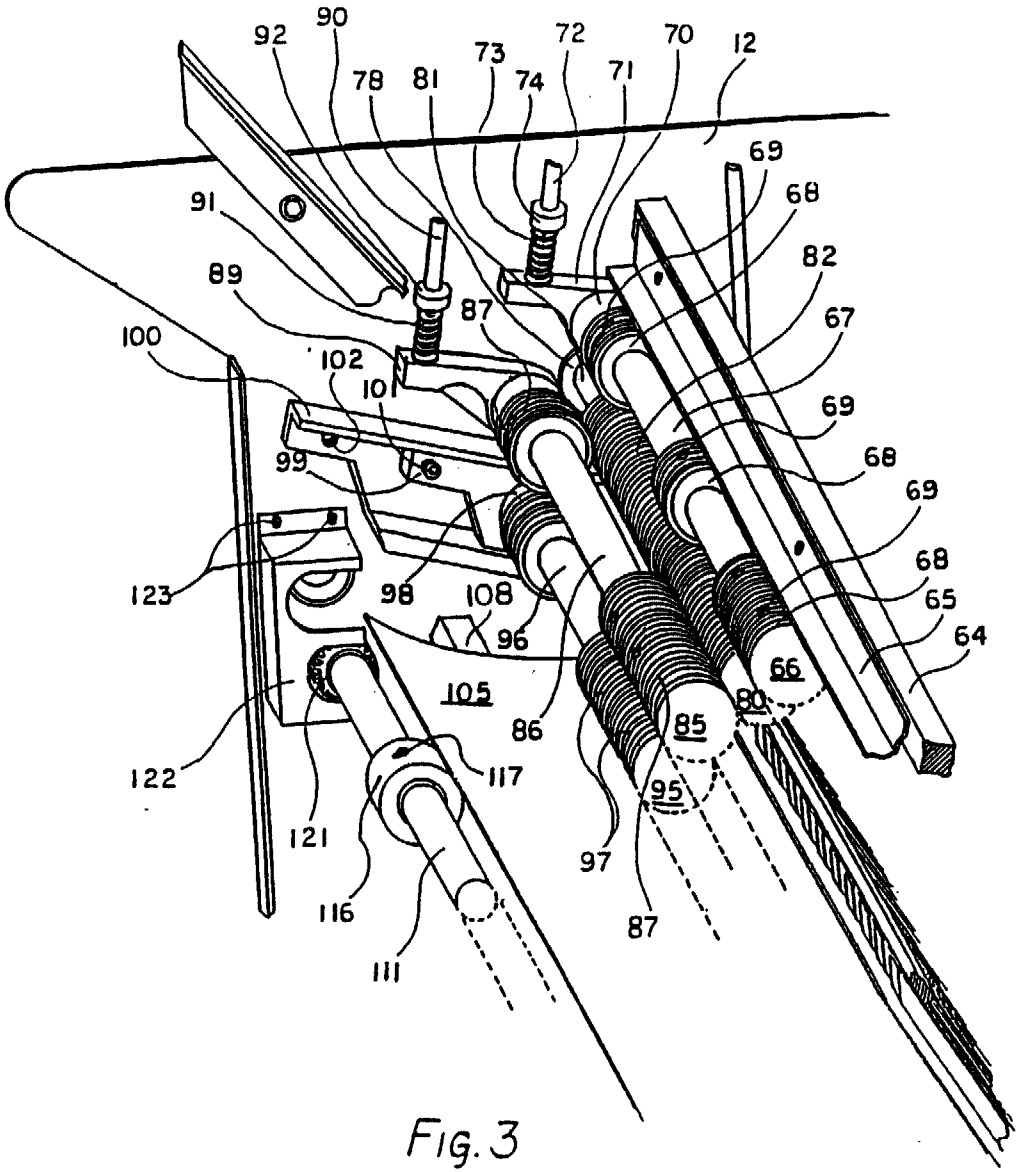
Figure 4:
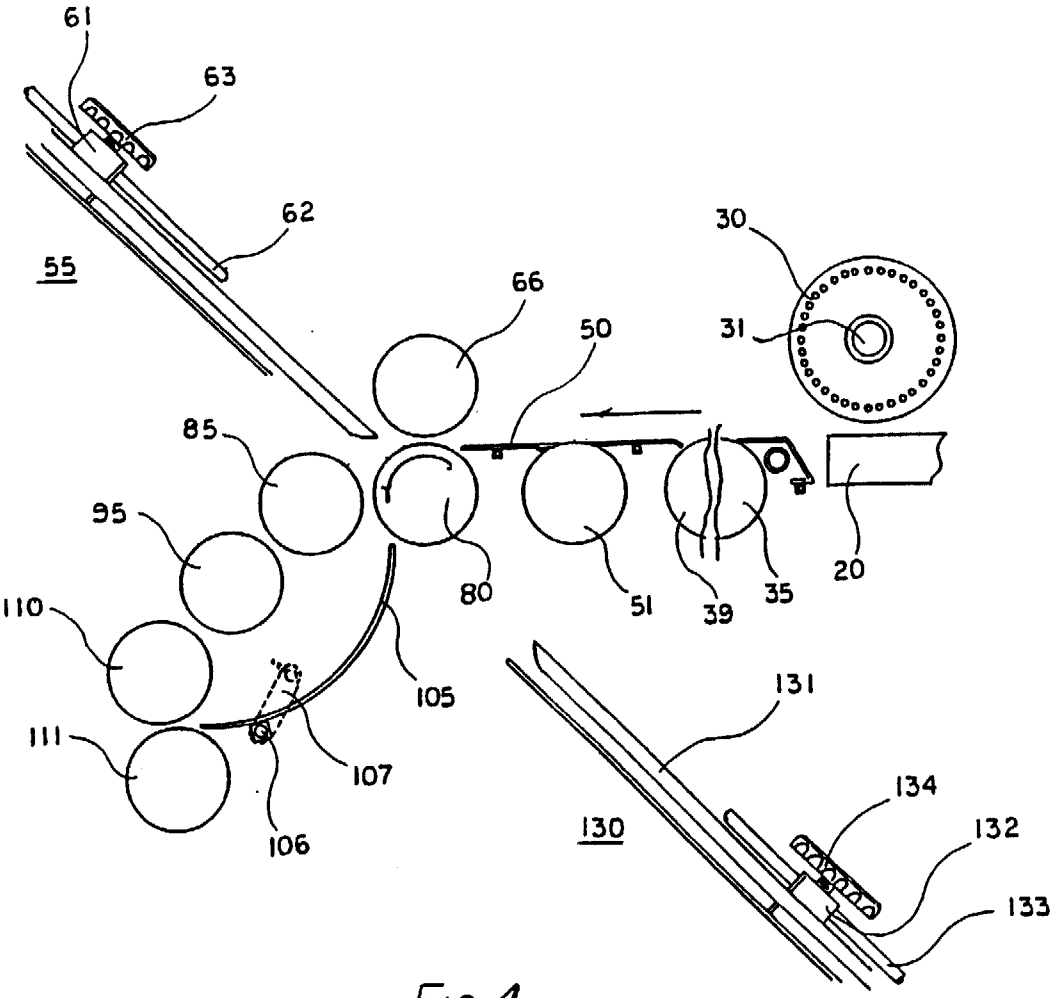
Figure 5:
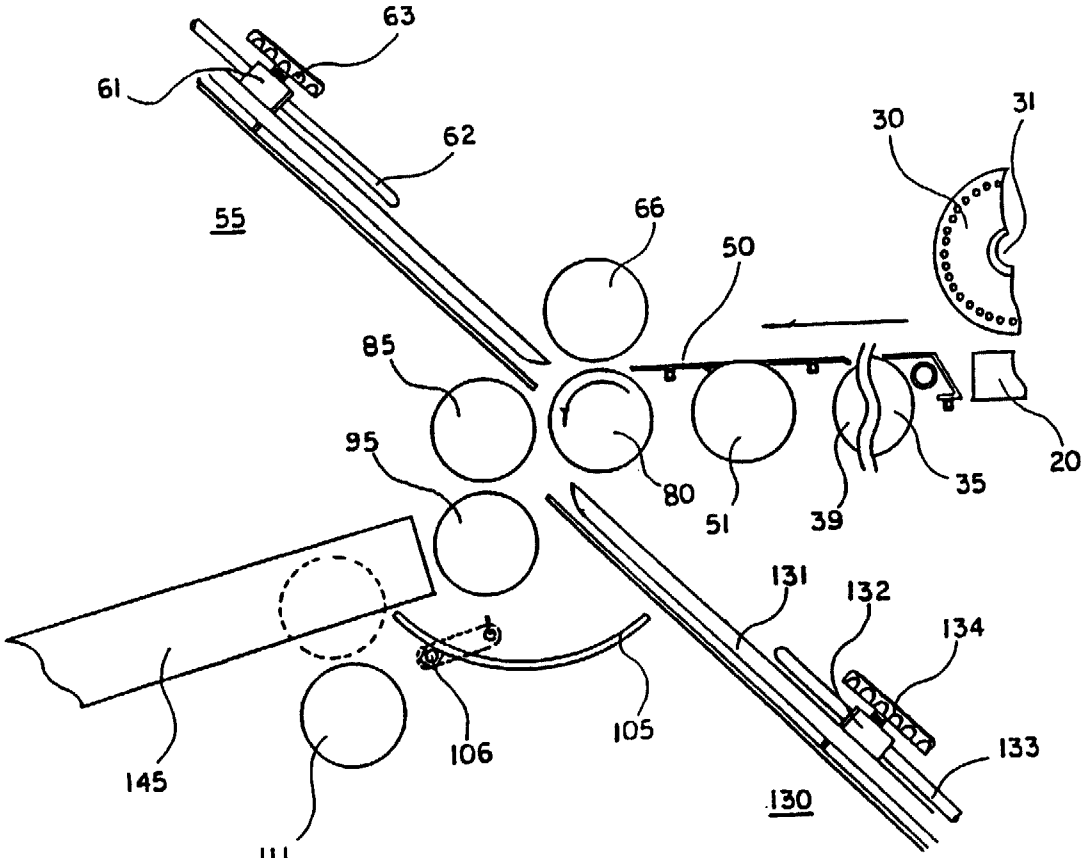
Figure 6:
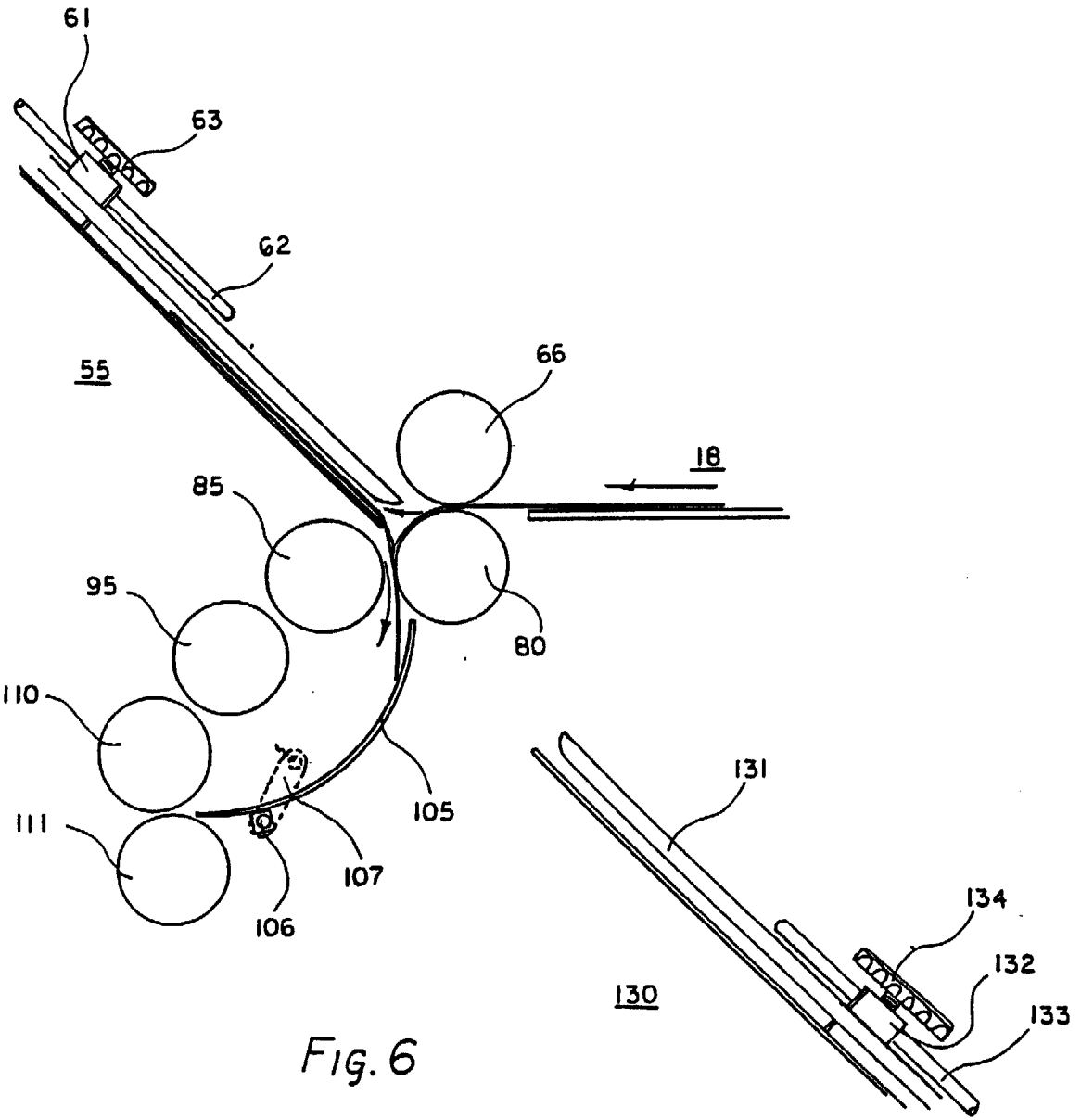
Figure 7:
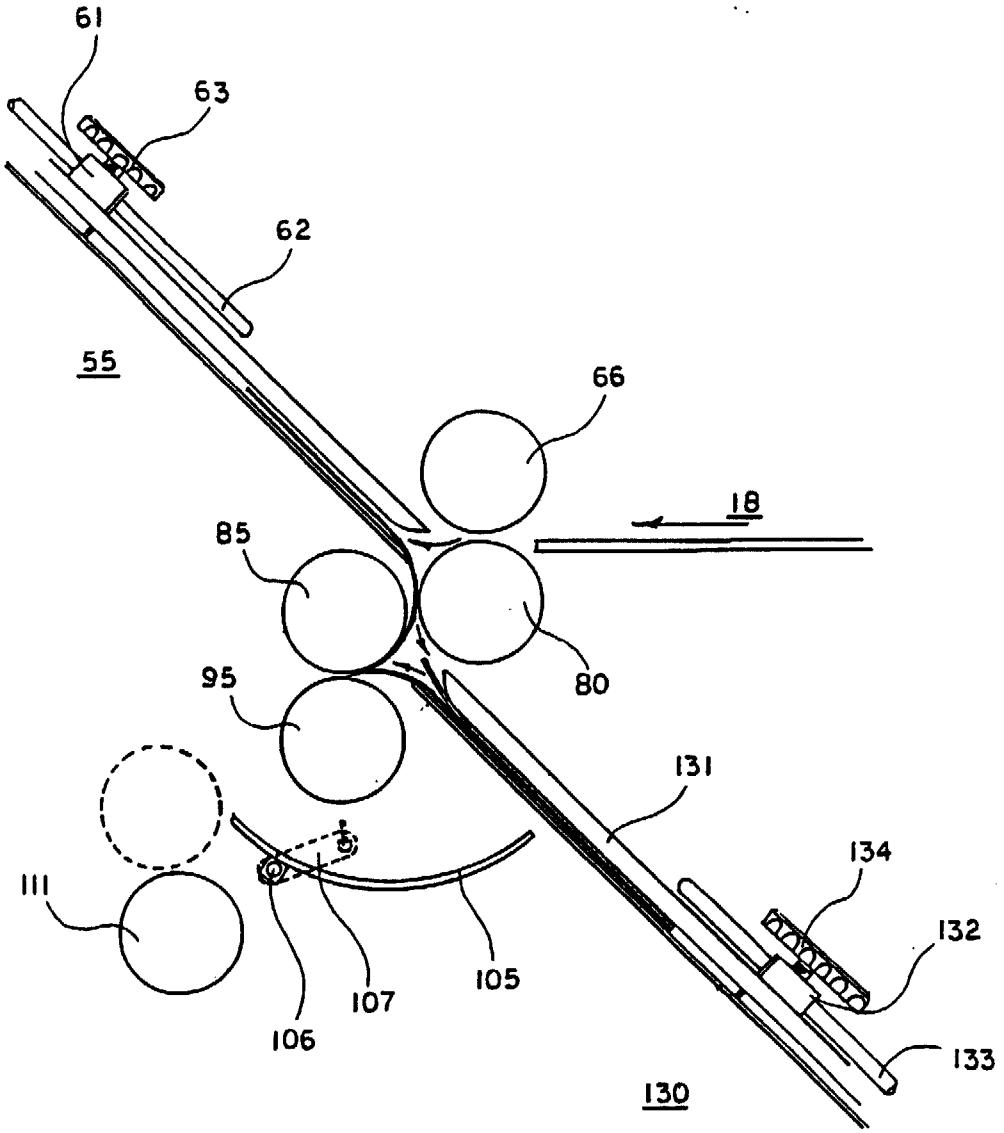

Referring now more particularly to the drawings and FIGS. 1–7 thereof, the two plate buckle folder 10 is therein illustrated, which includes side plates 11 and 12 connected by an entrance end plate 14, and by a plurality of beams 15.

The folder 10 has a document storage section 16, a feeding and transport section 17, and a folding and delivery section 18. The document storage section 16 includes a vertically movable plate 20, which holds documents (not shown) to be transported, and is automatically raised, and lowered by well known mechanism to present the documents (not shown) as required to the feeding and transport section 17.

A rod 21 is provided above the plate 20, spanning and connected to the side plates 11 and 12. The rod 21 has a pair of clamps 22 engaged therewith, which are movable therealong, with vertically extending threaded rods 23 engaged therewith, and with longitudinally extending L-shaped side guide plates 24 to align, and guide documents (not shown).

A clamp 25 is attached to rod 21 with a longitudinally extending arm 26, which has a clamp 27 engaged therewith, and with a vertically extending rod 28 therein, which has a cap 29 to engage the documents' (not shown) on plate 20.

The document feeding and transport section 17 includes a pick-off wheel 300, (is mounted above plate 20. The wheel of well known type which is 30 can be a suction wheel, mounted on a shaft 31, and has a tube 32 in communication with it and connected to a vacuum source (not shown). The shaft 31 is driven in well known manner (not shown).

A transport roller 35 is also provided, which extends between plates 11 and 12 to receive documents (not shown), a transport plate 36, is adjacent to roller 35, a roller 37 is adjacent to a transition plate 36, a plate 38 is adjacent to roller 37, a transport roller 39 is adjacent to plate 38, and a transition plate 40 is adjacent roller 39.

A transition plate 50 is provided adjacent plate 40, with a roller segment 51 carried therein to receive documents (not shown), and assist in their transition to the folding section 18.

It should be noted that rollers 37, 39, and 51 are driven in well known manner such as by belts or chains (not shown).

The folding section 18 includes a first fold plate 55 of well known type, which plate is of rectangular configuration with side members 57, and 58, and with a plurality of ribs 56 connected to end members 59 and 60. The fold plate 55 is carried in guides (not shown) on side plates 11 and 12. An adjustable document stop bar 61 is provided 1 carried on rod 62, which is connected to end members 59 and 60, and with a thumb screw 63 there in to engage rod 62, and retain bar 61 at selected locations thereon, depending on the size of document (not shown) and fold desired.

An end rod 64 is provided above member 59, of fold plate 55, with an L-shaped fold plate mounting rail 65 thereon, and with a first idler roller 66 having a shaft 67 therebelow, which has a plurality of spaced roller segments 68 thereon, which are retained on shaft 67 by screws 69.

The idler roller shaft 67 is journaled in bearings 70, which are engaged in arms 71, which are attached to side plates 11 and 12 by pins (not shown), with shafts 72 therein, and with springs 73, and collars 74 thereon, which are carried in blocks 75 on plates 11 and 12.

The shafts 72 are threadably engaged in blocks 75 and have heads 76, which can be rotated to move the shafts 72 and arms 71 to change the position of shaft 67.

A drive roller 80 is provided, below shaft 67, with a roller shaft 81 therein, and with a ribbed cover 82 thereon, of well known type, and preferably as shown, and described in my prior Pat. No. 4,375,971.

The roller shaft 81 is carried in bearings 78 in side plates 11 and 12, and is driven in a counterclockwise direction, in known manner (not shown). A safety hand wheel assembly 83 is provided, connected to shaft 81, which must be pulled out to engage and rotate shaft 81.

A second idler roller 85 is provided, having a shaft 86 with roller segments 87 thereon. The shaft 86 is journaled in arms 89, which are mounted to side plates 11 and 12, and rotate about pins (not shown) to change the position of roller 85.

Roller 85 is similar to roller 66 described above.

Shafts 90 are provided engaged in arms 89, with springs 91 and collars 92 thereon, which shafts 90 are threadably engaged in blocks 93 carried on side plates 11 and 12, with heads 94 thereon to rotate shafts 90, and change the position of roller 85. A third idler roller 95 is provided, similar to roller 85 with shaft 96, and which has segments 97 thereon.

The shaft 96 is journaled in bearings 98 carried, in blocks 99, which are slid ably mounted in brackets 100, which are mounted (not shown) to side plates 11 and 12. The blocks 99 can be positioned in the brackets 100, relative to the second idler roller 85, by cap screws 101 carried therein, which are engaged in holes 102 to retain the blocks 99 at selected locations to be described.

A chute 105 is provided below rollers 85 and 95, which is of semi-circular configuration, spans the side plates 11 and 12, is engaged in pins 106, which are carried in plates 11 and 12, and can be rotated about the pins 106.

Chute locking levers 107 are provided mounted to side plates 11 and 12, in engagement with brackets 108 on chute 105 to position it to active or inactive position, to be described.

A top ejector shaft 110 and a bottom ejector shaft 111 are provided. The ejector shafts 110 and 111 are engaged in bearing blocks 112 carried on the exterior of side plates 11 and 12.

Bearing blocks 112 are retained to side plates 11 and 12 by screws 114. The top and bottom ejector shafts 110 and 111 have a plurality of rollers segments 115 thereon, which have smooth surfaces 116, and are retained thereon by screws 117 therein. The shaft 110 has a gear 120 thereon, which is engaged with a gear 121 on bottom shaft 111, which is driven in well known manner (not shown). A cover 122 is provided, which extends over gears 120 and 121 for safety, and is secured to side plate 12 by screws 123.

A second fold plate 130 is provided, below and at an angle to drive roller 81. The second fold plate 130 is similar in construction to first fold plate 55, with ribs 131, adjustable document stop bar 132, which is carried on rod 133, and which is connected to end members (not shown) of plate 130.

The stop bar has a thumb screw 134 therein to engage rod 133, and retain bar 132 at selected locations depending on the size of document (not shown), and fold desired.

The fold plate 130 is carried in side guides (not shown), which are mounted to side plates 11 and 12, and permit the plate to be located in run, and inactive positions.

A control panel 140 is provided mounted to side plate 11, with appropriate controls to activate the roller drive mechanism (not shown), the pick-off wheel 30, and the plate 20 mechanism.

A table 145 is provided, of well known type, which receives documents (not shown) from the ejector shafts 110 and 111.

The mode of operation will now be pointed out.

When it is desired to apply a single buckle fold to documents, the mechanism should be set as illustrated in FIGS. 1, 2, 4, and 6, to which reference is made. In FIGS. 1, 2, 4, and 6, the third idler roller 95 has been moved to an out of engagement position with the other rollers. The chute 105 has been lifted to its topmost position, and locking levers 107 actuated to retain the chute 105 in active position. The second fold plate 130 has been moved down to an inactive position. The stop bar 61 has been set at the desired position.

The folder 10 is activated to rotate the pick off wheel 30, rollers 37, 39, and drive roller 81. Documents (not shown) from plate 20 are picked off one at a time by wheel 30, and transported to the folding section 18. The documents (not shown) are engaged by drive roller 81, and first idler roller 66, and are urged up ribs 56 one at a time until contact is made with stop bar 61. The continued rotation of drive roller 81 will force the bottom of the document (not shown) against second idler roller 85 causing the document to move between rollers 80 and 85 and downwardly producing a buckle fold. The document will then contact chute 105, and will be carried around until it contacts the roller segments 115 on top and bottom ejector shafts 110 and 111, which will pull the document (not shown) therebetween, and discharge it onto a storage table (not shown) or to other machinery (not shown) as required.

When it is desired to apply a two pocket buckle fold to documents, the folder mechanism should be set up as shown in FIGS. 1, 3, 5, and 7 to which reference is made.

The locking lever 107 is rotated and chute 105 it drops down into inactive position.

The cap screws 101 are removed, and bearing blocks 99 are positioned in brackets 100 to active position. Cap screws 101 are inserted into holes 102.

The screws 114 are removed from bearing blocks 112, and top ejector shaft 110 is removed. The second fold plate 130 is positioned in its guide plates until it is in the active position.

The folder 10 is activated and documents (not shown) travel as described above until they exit the first fold plate 55, where instead of immediately being engaged and pulled out they enter fold plate 130 until contact is made with stop bar 132.

The documents form a second fold and are engaged by rollers 85 and 95 and pulled out of second fold plate 130 and deposited onto table 145.

It will thus be seen that apparatus has been provided with which the object of the invention are attained.

I claim:

1. A buckle folder for forming at least one buckle fold on sheets of paper and the like which comprises:

a document storage section, a document feeding and transport section, a document folding and delivery section, said document storage section has a vertically movable plate to store and present a plurality of documents to said document feeding and transport section, said feeding and transport section includes a pick off wheel to pick off documents one at a time from said storage section, transition plates and transport rollers are provided in said feeding and transport section to receive documents from said pick-off wheel and transport them to said folding section, said folding and delivery section includes first and second fold plates, drive and first idler rollers are provided to grasp and transport said documents to said first fold plate from said feeding and transport section, a second idler roller is provided adjacent said drive roller, said first fold plate has a plurality of ribs to receive said documents and a stop bar to limit the travel of said documents, and urge said documents to engagement by said drive roller and said second idler roller pulling them out of said first fold plate whereby a single buckle fold is formed in said document selectively movable chute means to receive said folded documents and transport them, ejector means to grip and discharge said folded documents, said second fold plate is shiftable into engagement position so that a second buckle fold can be formed on said documents.

said ejector means includes a third idler roller which is movable to a document engagement position for performing a second buckle fold, and whereby said chute means is movable to out of document engagement position for said second buckle fold.

2. A folder as defined in claim 1 in which:

said ejector means includes top and bottom ejector shafts to receive said documents from said chute means and deliver them for use, and said top ejector shaft is readily removable.

* * * * *.

UNITED STATES PATENT AND TRADEMARK OFFICE

CERTIFICATE OF CORRECTION

PATENT NO. : 5,269,744

DATED : December 14, 1993

INVENTOR(S) : Richard J. Moll

It is certified that error appears in the above-identified patent and that said Letters Patent is hereby corrected as shown below:

Column 2

Line 63, delete "300" and insert --30--; before "is" delete "(" and insert --which--

Column 3

Line 3, "transport plate 36" should be "transition plate 36"

Line 4, before "roller 37" insert --transport--; before "plate 38" insert --transition--

Line 20, after "provided" delete "1"

Signed and Sealed this

Seventeenth Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,269,744

DATED : December 14, 1993

INVENTOR(S) : Richard J. Moll

It is certified that error appears in the above-indentified patent and that said Letters Patent is hereby corrected as shown below:

The title page showing the illustrative figure should be deleted to be substituted with the attached title page.

In the drawings, sheets 1 through 7 should be deleted and substitute therefore the attached sheets 1 through 7, consisting of figures 1-7, as shown on the attached pages.

Signed and Sealed this

Twenty-fifth Day of October, 1994

*Attest:*

Bruce Lehman

BRUCE LEHMAN

*Attesting Officer*

*Commissioner of Patents and Trademarks*

United States Patent [19]

Moll

[11] Patent Number: 5,269,744

[45] Date of Patent: Dec. 14, 1993

[54] TWO PLATE BUCKLE FOLDER

[76] Inventor: Richard J. Moll, c/o Dick Moll & Sons, Warminster, Pa. 18974

[21] Appl. No.: 886,365

[22] Filed: May 21, 1992

[51] Int. Cl.[5] ..... B65H 45/14

[52] U.S. Cl. ..... 493/421; 493/420

[58] Field of Search ..... 493/416, 419, 420, 421

[56] References Cited

U.S. PATENT DOCUMENTS

| | | | |
|---|---|---|---|
| 1,848,448 | 3/1932 | Weidner | 493/421 |
| 2,000,636 | 5/1935 | Flynt | 493/421 |
| 2,706,115 | 4/1955 | Rouan et al. | 493/421 |
| 3,008,707 | 11/1961 | McGarvey | 493/23 |
| 3,178,171 | 4/1965 | Springer et al. | 493/421 |
| 3,211,448 | 10/1965 | Stoothoff | 493/421 |
| 3,510,122 | 5/1970 | Gavaghan | 493/421 |
| 3,975,009 | 8/1976 | Brown | 493/14 |
| 4,619,101 | 10/1986 | Havey et al. | 53/117 |
| 4,668,212 | 5/1987 | Kotani | 493/216 |

*Primary Examiner*—William E. Terrell

*Attorney, Agent, or Firm*—Z. T. Wobensmith, III

[57] ABSTRACT

A two plate buckle folding machine, which can apply single buckle fold to card stock, and the like, and by disengaging shafts, shifting a fold plate into position, shifting a roller into position, and rotating a chute, change from a single to a two buckle fold folder.

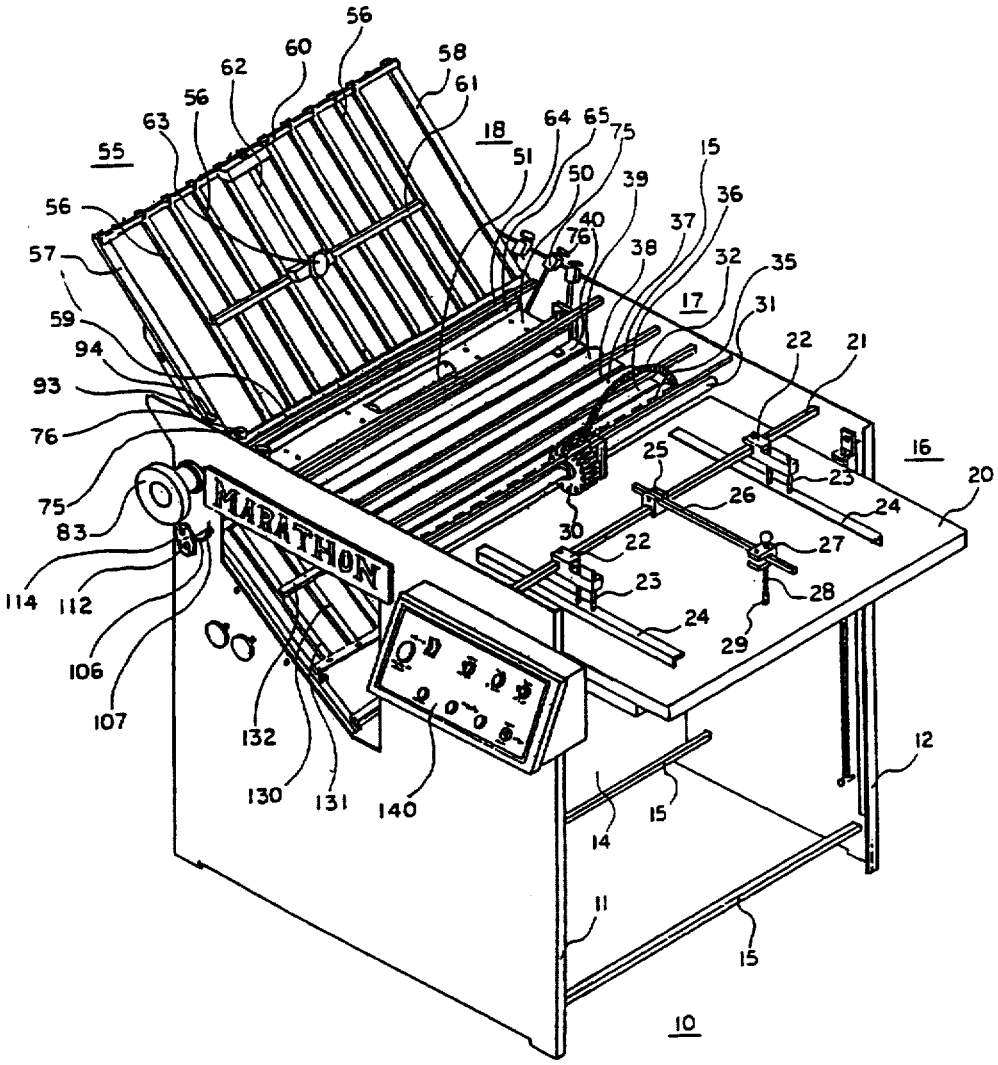

2 Claims, 7 Drawing Sheets